United States Patent [19]

Kowalski et al.

[11] Patent Number: 4,724,554

[45] Date of Patent: Feb. 16, 1988

[54] TILTING PATIENT TREATMENT TABLE HAVING SAFETY SWITCH MAT MECHANISM

[75] Inventors: Frank P. Kowalski, Des Plaines; Gerald R. Scott, Elmhurst, both of Ill.

[73] Assignee: Standex International, Salem, N.H.

[21] Appl. No.: 906,374

[22] Filed: Sep. 12, 1986

[51] Int. Cl.[4] ..... A61G 7/00; A61G 13/00; A47C 27/08

[52] U.S. Cl. ..... 5/62; 5/424; 269/323

[58] Field of Search ..... 5/424, 62, 61, 60; 269/323, 325, 324, 322; 378/177, 179, 195, 196, 209

[56] References Cited

U.S. PATENT DOCUMENTS

| | | | |
|---|---|---|---|
| 3,822,875 | 7/1974 | Schmedemann | 378/209 X |
| 4,045,078 | 8/1977 | Shine | 269/324 |
| 4,059,255 | 11/1977 | Perold | 269/323 |
| 4,067,005 | 1/1978 | Levy et al. | 5/424 X |
| 4,325,061 | 4/1982 | Wolar | 5/424 X |
| 4,407,030 | 10/1983 | Elliott | 5/424 X |
| 4,453,463 | 8/1984 | Kaneko | 5/424 X |
| 4,534,077 | 8/1985 | Martin | 5/424 |
| 4,613,997 | 9/1986 | Langdale | 5/62 |

*Primary Examiner*—Alexander Grosz
*Assistant Examiner*—Carl M. DeFranco, Jr.
*Attorney, Agent, or Firm*—Mason, Kolehmainen, Rathburn & Wyss

[57] ABSTRACT

A patient treatment table for supporting a patient laying in a generally horizontal position for treatment at an elevated level above the floor surface includes a base adapted to rest on the floor surface for supporting the table for movement between a first position for patient treatment and a second position for mounting and dismounting. The table includes a control system for moving the table between said positions having an electric motor and/or electrically activated hydraulic control valves and a safety system for deenergizing the electric motor and/or deactivating the control valves in response to a hazardous condition. The system includes a switch mat positioned on the floor surface adjacent the base which is operative to deenergize the electric motor and/or deactivate the control valves in response to pressure applied to the switch mat. The table includes further safety systems activated by pressure applied for preventing injury to a patient's foot, arm or limb as the table is moved from the second position toward the first position.

22 Claims, 4 Drawing Figures

TILTING PATIENT TREATMENT TABLE HAVING SAFETY SWITCH MAT MECHANISM

BACKGROUND OF THE INVENTION

1. Field of the Invention

The present invention relates to a new and improved patient treatment table for supporting a patient laying in a generally horizontal position for chiropractic treatment and the like at an elevated level above a floor surface. The table of the present application is an improvement on the patient treatment table shown and disclosed in copending U.S. patent application for a Patient Treatment Table, filed Mar. 21, 1985, under Ser. No. 714,486, and assigned to the same assignee as the present application.

More particularly, the present invention relates to a patient treatment table having a safety system incorporated therein for preventing inadvertent damage or injury to persons and equipment as the table structure is being moved. In addition, the new and improved safety system of the present invention is especially adapted for use with a Patient Treatment Table of the type shown and described in U.S. Pat. No. 4,401,110 and/or copending U.S. patent application, Ser. No. 739,988, filed May 31, 1985, and also assigned to the same assignee as the present application.

2. Description of the Prior Art

Over the years, patient treatment tables for chiropractic manipulation of patients lying on a table surface in a generally horizontal position have been greatly improved. With the advent of power driven systems for moving the table surface between different levels and for tilting the table surface from a horizontal position toward an upstanding position to facilitate a patient in mounting and dismounting from the table have greatly improved the efficiency of a chiropractor in handling patients of different size and weight. However, a problem sometimes encountered with modern day patient treatment tables is the danger of pinching or injuring a finger, hand, foot, leg or limb of a person or child as the table is lowered and/or raised.

OBJECTS OF THE PRESENT INVENTION

It is an object of the present invention to provide a new and improved patient treatment table of the character described which incorporates a safety system for eliminating altogether or greatly reducing the possibility of inadvertent injury or damage to persons and objects as the table structure is being lowered, raised or tilted to or from a horizontal position or level.

Another object of the present invention is to provide a new and improved safety system for a chiropractic patient treatment table of the type having a table structure which is movable relative to a base structure and, in particular, a patient treatment table of the type shown and disclosed in the aforementioned copending U.S. patent application, Ser. No. 739,988, filed May 31, 1985 which includes a tuckaway footboard for supporting a patient during mounting and dismounting while the table structure is in an upwardly extending position.

In particular, it is an object of the present invention to provide a new and improved patient treatment table of the character described employing switch mat safety system for preventing inadvertent injury to an object in close proximity to the end portion of the table where a patient supporting footboard approaches the floor during elevation of the table structure.

Yet another object of the present invention is to provide a new and improved safety system for chiropractic manipulation apparatus of the character described having pressure responsive safety devices for preventing continued travel of the table relative to the base when a hazardous condition is encountered.

It is another object of the present invention to provide a new and improved patient treatment table of the character described which embodies all of the advantageous features of the patient treatment table shown and described in U.S. application Ser. No. 739,988, heretofore mentioned and in addition, includes a switch mat safety system for preventing possible injury and damage to persons and things in the immediate vicinity of the base structure at floor level or at an elevated level thereon.

BRIEF SUMMARY OF THE INVENTION

The foregoing and other objects and advantages of the present invention are accomplished in a new and improved patient treatment table of the character described which includes a table structure for supporting a patient laying in a generally horizontal position for treatment at an elevated level above a floor surface. A base adapted to rest on the floor surface is provided for supporting the table for movement between a first position for patient treatment and a second position for accommodating the patient for mounting and dismounting to and from the table. A control system is provided for moving the table between the first and second positions including an electric motor, and/or electrical-actuated hydraulic control valves and a safety system is included for deenergizing the electric motor and/or deactivating the control valves in response to possible hazardous conditions responsive to pressure on the surface of a switch mat which is positioned closely adjacent the base on the floor surface. In the table of the present invention, the switch mat is positioned adjacent to one end of the base structure to underlie a lower end portion of the table structure which may include a footboard on which a patient's weight is supported while a patient is mounting and dismounting from the table. As the footboard or end portion of the table structure approaches the switch mat, if a person or object is pinched therebetween, pressure is exerted on the switch mat and this is effective to deenergize the electric motor and/or deactivate the control valves and stop further downward travel of the table structure. The safety system of the invention also includes one or more pressure sensitive safety elements mounted on the base structure underneath the main portion of the table so that as the table is moved downwardly toward a horizontal position, an object or person's limb between the underside of the table structure and a pressure sensitive safety element will automatically cause the electric motor to be deenergized and/or the control valves to be deactivated and thus avoid injury.

BRIEF DESCRIPTION OF THE DRAWINGS

For a better understanding of the present invention, reference should be had to the following detailed description taken in conjunction with the drawings in which.

BRIEF DESCRIPTION OF THE PREFERRED EMBODIMENT

Figure 1:
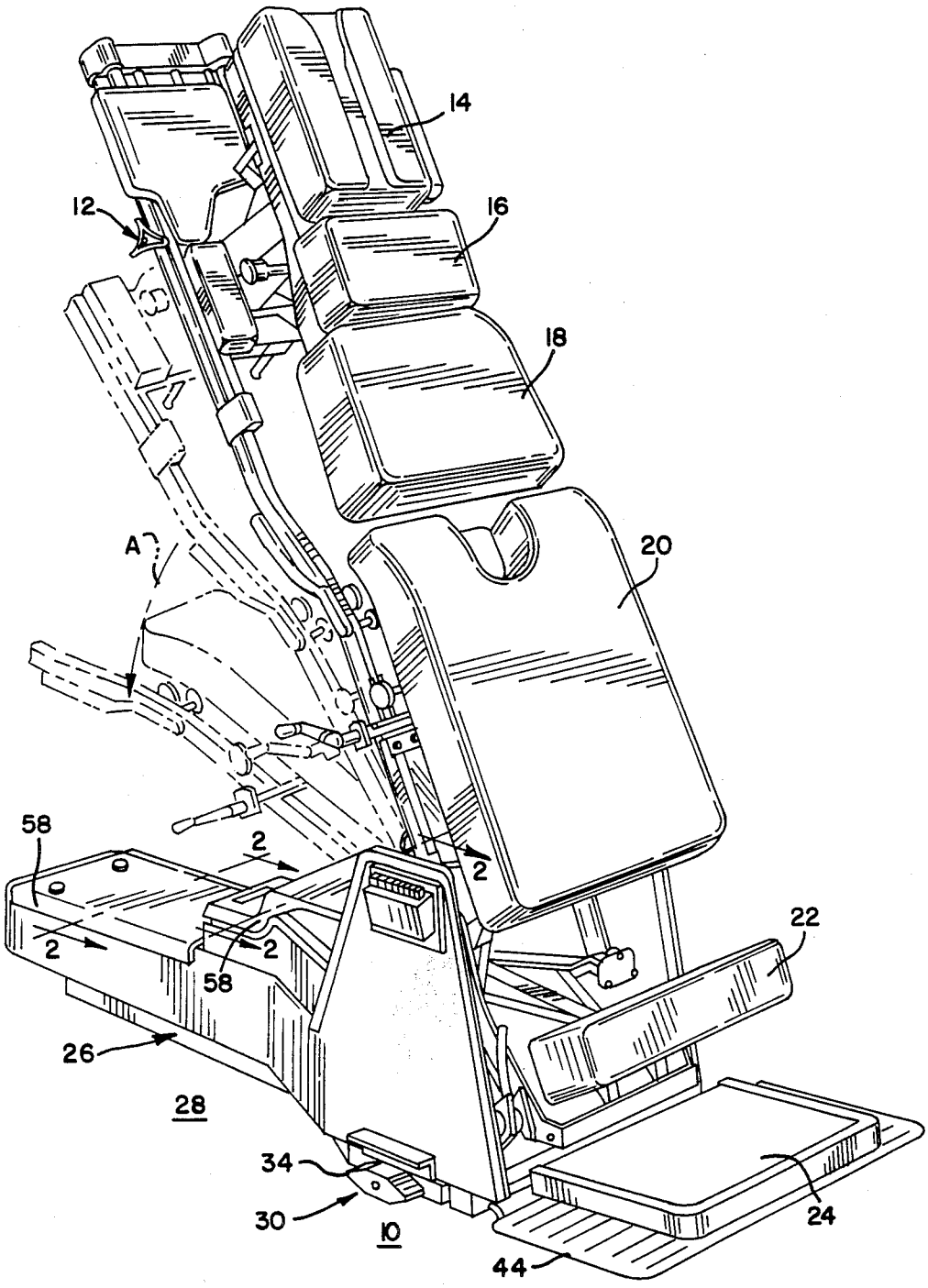
FIG. 1 is a front elevational, perspective view of a new and improved patient treatment table constructed in accordance with the features of the present invention.
Figure 2:
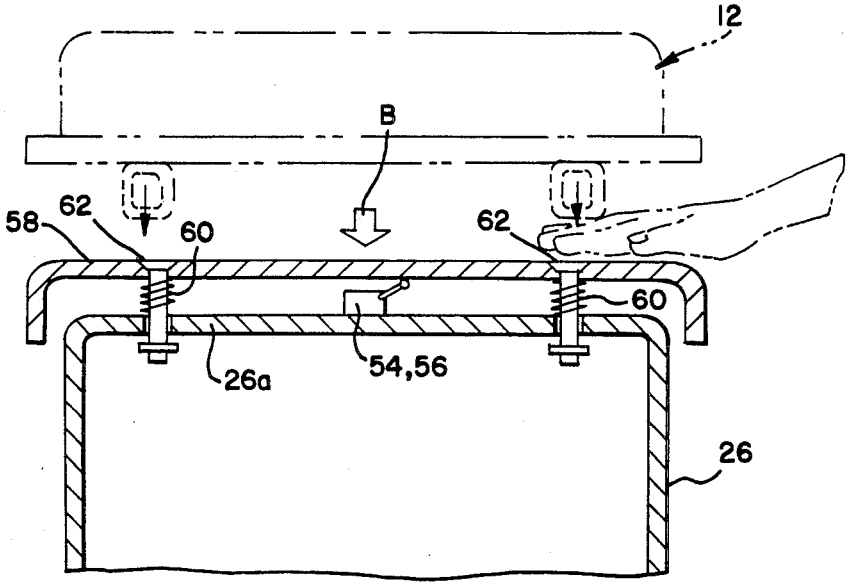
FIG. 2 is a transverse, fragmentary, cross-sectional view taken substantially along parallel section lines 2—2 of FIG. 1.
Figure 3:
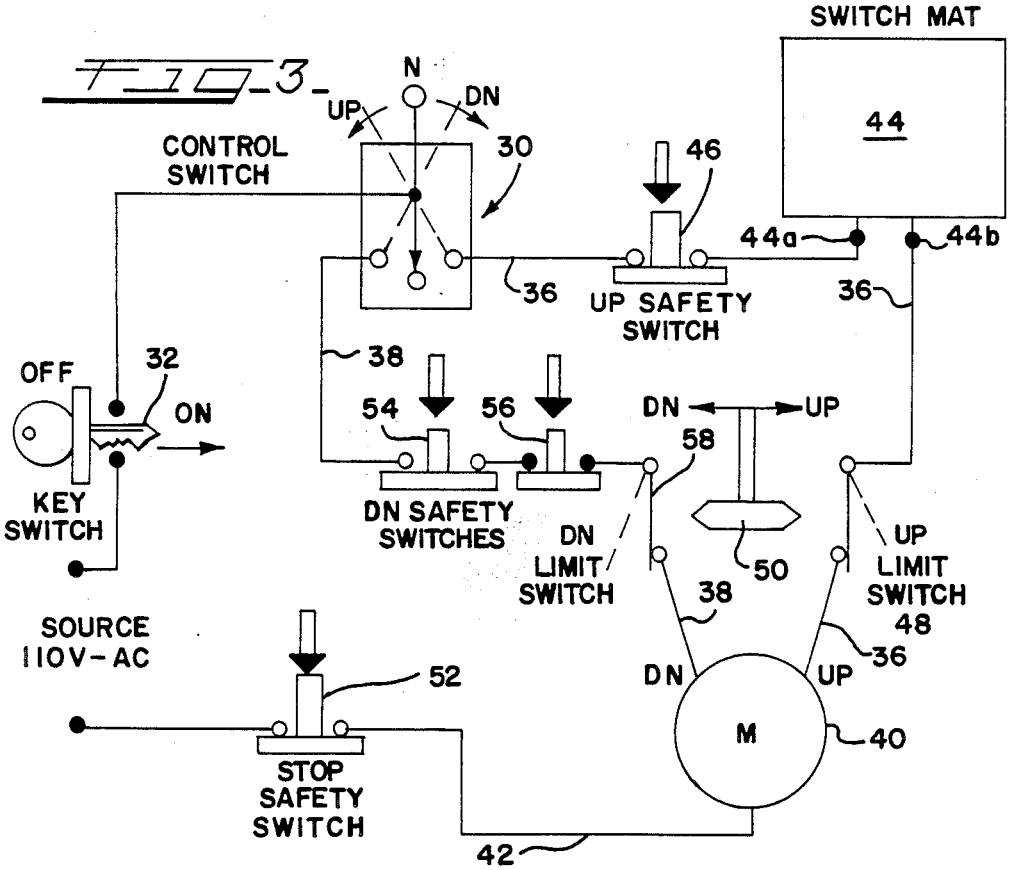
FIG. 3 is a schematic diagram of one embodiment of an electrical circuit for controlling the table and safety system thereof.

Referring now, more particularly, to FIGS. 1-3 of the drawings, therein is illustrated a new and improved patient treatment table constructed in accordance with the features of the present invention and referred to generally by the reference numeral 10. The table 10 is an improvement on the patient treatment table disclosed in copending U.S. patent application Ser. No. 739,998, incorporated herein by reference, and includes an elongated, upper patient supporting table structure 12 having a plurality of separate patient support cushions 14, 16, 18, 20, 22 and a retractable footboard 24.

The upper table structure 12 is pivotally attached adjacent a front end portion to an elongated base structure 26 which rests on a floor surface 28. The table structure is adapted to pivot between a first, generally horizontal position for treatment of a patient while laying on the cushions and an upwardly extending or tilted second position as shown in solid lines in FIG. 1 for enabling a patient to easily mount and dismount from the table by stepping onto and off of the footboard 24.

When the table is in the upwardly extending second position, the footboard projects outwardly from the patient supporting surfaces of the cushions 14, 16, 18, 20 and 22 and when the table structure is in the horizontal, first position the footboard is retracted. When the table structure is pivoted downwardly. as indicated by arrow "A" and the dotted lines in FIG. 1 toward the first or horizontal, patient treatment position, the footboard 24 is retracted gradually as the patient's weight is accepted on the cushion surfaces. Similarly, when the table structure 12 is pivoted upwardly from the horizontal position toward the upwardly tilted second position, the patient's weight is gradually relieved from the cushion surfaces and is transferred from the patient's feet to the footboard 24 which moves to extend outwardly from the surface of the cushions as shown in FIG. 1.

As more fully described in the copending U.S. patent application Ser. No. 739,988, which is incorporated herein by reference, the table 10 includes an electrically controlled electric or electro-hydraulic system for moving the upper table structure 12 between alternate positions. Referring to FIG. 3, the table includes an electrical control circuit having a multi-step control unit 30 preferably of the type shown and described in copending U.S. patent application for a patient treatment table filed Mar. 21, 1985 under Ser. No. 714,486, which patent application is also incorporated herein by reference.

Electrical power is supplied from a convenient source of 110 volt alternating current through a key operated on and off switch 32 to the multi-step control unit 30 which is shown only in general schematic form in FIG. 3 but which is described in greater detail in the aforementioned copending U.S. patent application. The control unit includes a pair of foot operated control pedals 34 on opposite sides of the base 26 and the pedals are normally positioned in a neutral position when the table is stationary and movement is not being required.

Foot actuation of the control pedals 34 is effective to supply energy electrical power to an upside line 36 or a downside power line 38. The lines 36 and 38 provide electrical power for an electrical motor or an electrically controlled, hydraulic system shown schematically as motor means 40 in the diagram of FIG. 3. The electric motor means is provided with current from an opposite side of the 110 volt AC power source via a common line 42. When power is supplied to the motor 40 from the downside line 38, the table 12 is driven to move from an upstanding or upwardly tilted position shown in FIG. 1 in solid lines in a downward direction toward a horizontal or first position as indicated by the arrow "A". When electrical power is supplied to the motor means 40 through the upside line 36 the table structure 12 begins to pivot upwardly and moves in a direction opposite to the arrow "A" of FIG. 1 toward the second or upstanding tilted position as shown in solid lines.

In accordance with the safety system of the present invention and an embodiment thereof as shown in FIG. 3, the table 10 is provided with a relatively large area, rectangular shaped, switch mat 44 of the type generally used for controlling commercial doors and the like, and the switch mat includes an upper surface area sensitive to the application of pressure at any location thereon to open a safety circuit between a pair of external switch mat terminals **44*a* and 44*b*. When no downward pressure is exerted on the upper surface of the switch mat, a closed circuit exists between the terminals 44*a* and 44*b*. These terminals are connected in the upside power line 36 in series with a pressure sensitive safety switch 46 which is located at any convenient spot on the table structure, and an upside limit switch 48 is also provided in the line 36 for interrupting power to the motor 40 when the switch is opened as the table structure 12 reaches a maximum upwardly tilted position. For this purpose, a switch operator 50 is provided on the table structure to move into contact to open the upper limit switch 48** when the table structure reaches the maximum upwardly tilted position as shown.

As the multi-step control unit 30 is activated to move the table structure 12 from the horizontal or first position to tilt upwardly toward the second position, the retractable footboard 24 begins to move outwardly in order to accept the patient's weight. As the head end of the table structure 12 approaches a maximum upper level, the underside of the footboard 24 closely approaches the upper surface of the pressure sensitive switch mat 44. If a person's foot, limb, hand or other object is present on the switch mat at any time or is between the footboard and the switch mat so as to exert pressure on the switch mat, the normally closed contacts of the switch mat are opened so that electrical energy to the motor means 40 is interrupted and thus damage or injury is averted. When the motor means 40 is deenergized in this manner, further downward travel of the footboard toward the floor is curtailed. The switch mat thus functions as a safety device effective to preclude inadvertent damage or injury to persons or things in the immediate vicinity of the foot end of base structure 26 at the floor level while the footboard 24 is moving downwardly toward the switch mat. In addition, the switch mat serves as a backup limit switch for cutting off the power to the electric motor means 40 in the event that the upper limit switch 48 does not properly function.

As another added safety feature, a stop safety switch 52 is provrded in the line 42 and this switch is mounted at a convenient location on the table so that movement of the table up or down can be stopped instantaneously when the safety stop switch 52 is depressed. The table 10 also includes another safety system having a plurality of safety limit switches 54 and 56 connected in series with a downside limit switch 58 adapted to be actuated by the switch operator 50 when the table reaches the horizontal position. The safety switches 54 and 56 are connected in series in the line 38 and function to preclude further downward travel of the table structure 12 in the direction of arrow "A" as shown in FIG. 1.

As illustrated in FIGS. 1 and 2, the base structure 26 includes a pair of safety cover plates 58 of channel-shaped transverse cross-section and each safety plate is supported from a top wall 26a of a housing of the base on a plurality of coil springs 60 mounted on depending cap screws 62. These screws project downwardly from the safety cover through apertures provided in the top wall 26a of the base housing. The safety switches 54 and 56 are mounted on the upper surface of the top wall 26a so that downward on either one of the safety covers 58 (as indicated by the arrow "B" in FIG. 2) caused by the table structure itself or a person's hand or limb or other object interposed between the underside or table structure and the safety cover will cause the safety switches 52 or 54 to open and cut off power from the downside line 38 to the electric motor 40. This action prevents any further downward travel of the table toward the base. Should a patient's arm, hand or any person's limb or other object be inadvertently positioned between one of the safety covers 58 on the base structure 26 and the downwardly traveling undercarriage of the table structure 12 so as to apply sufficient pressure to either safety cover 58, either or both of the switches 54 or 56 will be opened and further downward travel of the table is interrupted and injury or damage thereby averted.

It will thus be seen that the table 10 in accordance with the present invention includes all the features of the patient treatment tables of copending U.S. applications Ser. No. 739,988 and Ser. No. 714,486 and additionally includes a switch mat safety system as described along with a plurality of safety systems for interrupting downward travel of the table structure in the event of pressure exerted between the table structure and underlying base. The table 10 thus provides a safe and efficient system for the manipulation and treatment of chiropractice patients and greatly aids a practitioner in the safe and efficient handling of the table.

Figure 4:
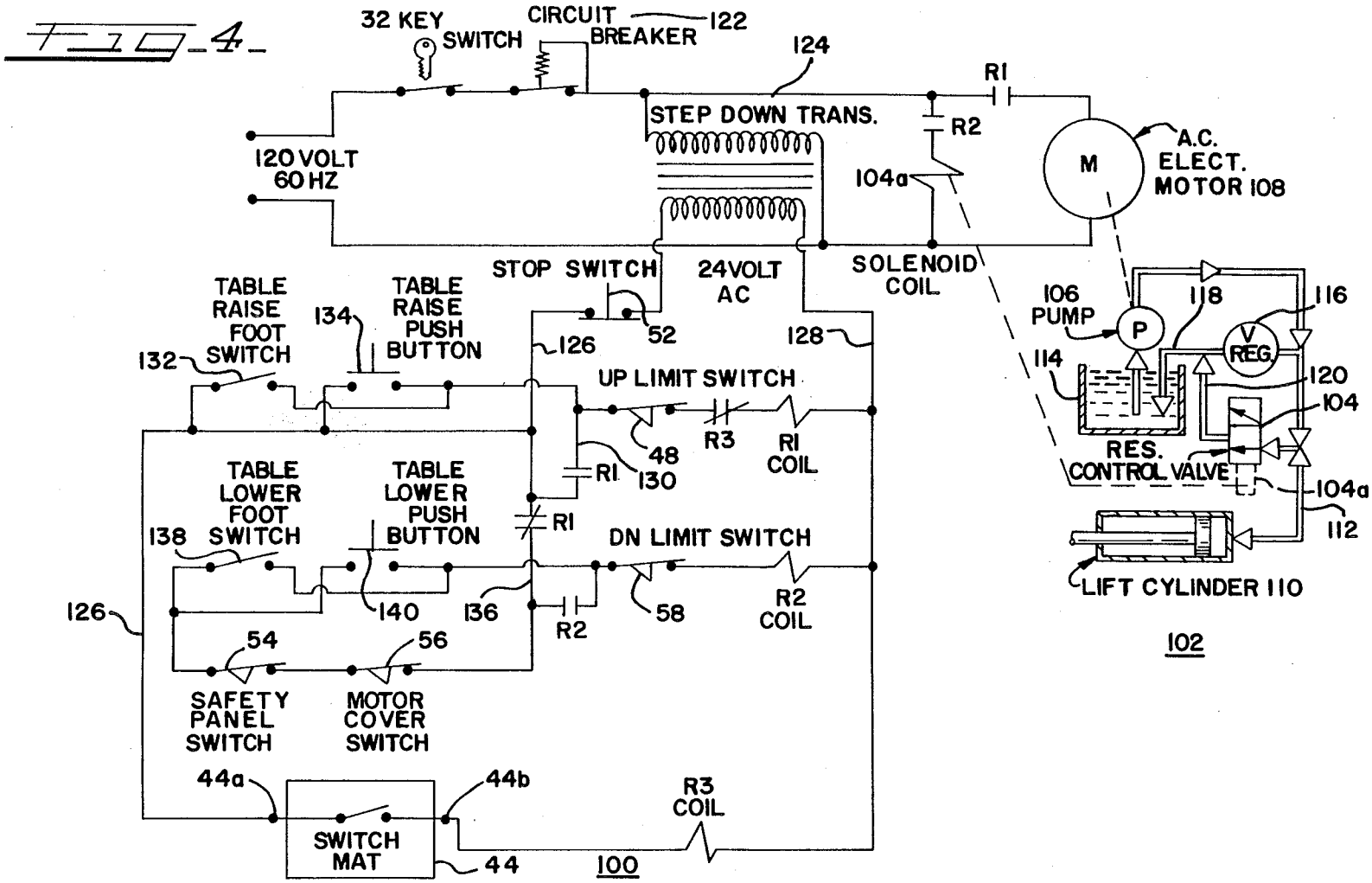
FIG. 4 is a schematic diagram of another embodiment of an electrical circuit and safety system for controlling a table of the type having a hydraulic system with at least one solenoid control valve for use in raising and lowering the table.

Referring now more particularly to FIG. 4, therein is illustrated another embodiment of a table control and safety system 100 employing a switch mat 44 and adapted to be incorporated in tables of the type shown in U.S. Pat. No. 4,401,110 and copending U.S. patent applications Ser. Nos. 775,226; 714,486 and 739,988 which may employ an electrically controlled hydraulic system such as a hydraulic system 102 for raising and/or lowering a patient supporting table surface and activated and controlled by one or more solenoid controlled hydraulic valves 104.

The hydraulic system includes a hydraulic pump 106, driven by an A.C. powered electric motor 108 and a single acting lift cylinder 110 is provided for moving the table structure 12 upwardly from a lower position to an elevated position when pressurized hydraulic fluid from the pump is supplied to a piston end of the cylinder through a supply line 112. Hydraulic fluid for system operation is supplied from a reservoir 114 to the inlet side of the pump 106 and fluid is returned to the reservoir through a pressure relief valve 116 and return line 118. When the electric motor 108 is energized to drive the pump 106, hydraulic fluid under working pressure is supplied to the piston end of the lift cylinder 110 to extend the piston rod for raising the table structure 12 to the upper position. This table position is maintained by entrapped fluid in the hydraulic cylinder while the solenoid controlled valve 104 is in the position illustrated wherein fluid flow from the cylinder cannot be returned to the reservoir 114 via a normal return path from the valve 104 through an outlet line 120 running from an outlet port on the valve body to the return line 118.

When a solenoid coil 104a of the valve 104 is energized, the valve element moves to an alternate position wherein hydraulic fluid is returned from the cylinder 110, through line 112, valve 104 and lines 120 and 118 back to the reservoir 114. The weight of the table structure 12 and if a patient is present thereon, the added patient weight acts through the mechanical linkage and the piston rod to move the piston toward the piston end of the cylinder and thereby return the fluid from the cylinder to the reservoir at a controlled rate to let the table and patient down slowly. The particular hydraulic system 102 as depicted in FIG. 4 utilizes hydraulic fluid under pressure to raise the table and patient and uses the weight of the table and patient to lower the table. Another type of suitable electro-hydraulic system is shown in FIG. 11 of U.S. Pat. No. 4,401,110 (incorporated herein by reference), wherein a double acting cylinder is provided with separate solenoid valves in the up and down side hydraulic lines running to opposite ends of the cylinder.

In accordance with the system of FIG. 4, the 120 volt A.C. electric motor 108 is energized to drive the pump 106 whenever the key switch 32, a circuit breaker 122 and a pair of normally open contcts R1 are closed by energization of a relay coil R1. A step down transformer 124 has a primary side connected across the A.C. line and provides a source of low voltage A.C. at 24 volts for the control system coils. The secondary of the step down transformer provides a source of 24 volts A.C. to a pair of low voltage (24 volts A.C.) supply lines 126 and 128 for selectively energizing the relay coils R1, R2 and R3. The switch mat 44 is connected in series with the relay coil R3 across the low voltage lines 126 and 128 and whenever sufficient pressure or weight is present on the switch mat the coil R3 becomes energized. In a system like that of FIG. 11 in U.S. Pat. No. 4,401,110, the switch mat 44 is incorporated in series with the switch 266 to prevent further upward movement of the table when pressure is encountered on the mat.

Energizing the R3 coil causes a pair of normally closed contacts R3 to open and these contacts are connected in series with the coil R3 and the up limit switch 48 between the line 128 and an up side power line 130 which is energized from the supply line 126 whenever a table raise foot switch 132 of the multi-step control 30 is closed or a table raise push button 134 is depressed.

Energizing the R1 coil causes a first set of normally open contacts R1 to close for energizing the A.C. motor 108 to drive the hydraulic pump 106 and raise the table structure 12 until the up limit switch 48 is activated or the switch mat is pressurized to energize the R3 coil and open the normally closed R3 contacts. When the R1 coil is energized, a second set of normally open, holding coil R1 contacts are closed and a third set of normally closed R1 contacts are opened to disconnect power from the line 126 to a down side power line 136 provided for energizing the coil R2 when desired.

When the normally closed contacts R1 are in the normally closed position, power from the supply line 126 is connected directly to the downside power line 136. In the downside power line, the safety panel switch 54 and the motor cover switch 56 are connected in series with a pair of parallel connected, normally open switches comprising a table lowering foot switch 138 of the multi-step control unit 30 and a table lowering push button 140. Activation of either of the switches 138 and 140 supplies power from the line 136 to one side of the down limit switch 58 connected in series with the coil R2 and the line 128. This causes the R2 coil to be energized and closes two sets of normally open contacts R2. One set of R2 contacts causes the solenoid coil 104*a* to be energized to move the valve 104 to an alternate position for lowering the table structure 12 until the down limit switch 58 is opened or the switch mat contacts are closed to prevent further travel downward. A second set of normally open R2 holding coil contacts are also closed to supply power directly to the R2 coil as long as the down limit switch 58 is not opened. If any of the safety switches 52, 54 or 56 are depressed, further downward travel of the table structure 12 is stopped, and when the table reaches a fully down position, the down limit switch 58 is then opened to deenergize the coil R2 and open the R2 contacts to deenergize the solenoid coil 104*a*. When this occurs, the control valve 104 returns by spring bias to the position shown ready for the next table elevation process to be initiated.

Although the present invention has been described with reference to a single illustrated embodiment thereof, it should be understood that numerous other modifications and embodiments can be made by those skilled in the art that will fall within the spirit and scope of the principles of this invention.

What is claimed as new and is desired to be secured by Letters Patent is:

1. Patient treatment apparatus, comprising:

a table having a surface for supporting a patient laying in a generally horizontal position for treatment at an elevated level above a floor surface said table having an end portion substantially perpendicular to said patient supporting surface;

a base adapted to rest on said floor surface, said base supporting said table for movement between a first substantially horizontal position for patient treatment and a second upstanding position for patient mounting and dismounting wherein said end portion of said table closely approaches said floor surface and allows said patient to mount upon and dismount from said table and end portion when said table is in said second upstanding position;

control means for moving said table between said first and second positions including electric motor means; and safety means for deenergizing said electric motor means in response to a hazardous condition including switch mat means supported on said floor surface independently of said base and positioned on said floor surface adjacent said base directly below said approaching end portion of said table moving toward said second position.

2. The patient treatment apparatus of claim 1, wherein said switch mat includes a generally planar upper surface of substantial area adjacent said base responsive to downward pressure thereon to deenergize said electric motor.

3. The patient treatment apparatus of claim 1, wherein;

said table is supported for pivotal movement relative to said base between said first generally horizontal position and an upwardly extending second position wherein an end portion of said table downwardly approaches said switch mat means.

4. The patient treatment apparatus of claim 3, wherein;

said end portion of said table includes a footboard for supporting a patient in an upwardly extending position for mounting and dismounting from said apparatus as said table is pivoted toward said second position, said footboard being movable toward an outwardly extending position overlying said switch mat when said table is in said second position.

5. The patient treatment apparatus of claim 4, wherein; an underside of said footboard is positioned for movement toward engagement with said switch mat as said table is pivoted toward said second position, and wherein pressure exerted by said underside of said footboard and transmitted to said switch mat is effective to deenergize said electric motor.

6. The patient treatment table of claim 5, including;

safety means for deenergizing said electric motor as said table approaches said horizontal first position wherein a portion of said table approaches an underlying portion of said base.

7. The patient treatment apparatus of claim 6, wherein;

said safety means includes a safety switch normally biased toward a switch closed position for energizing said electric motor for moving said table relative to said base, and a safety switch actuator mounted on one of said base and said table operable to actuate said safety switch to an open position in response to pressure applied to said actuator for deenergizing said electric motor to prevent further movement of said table portion toward said base portion.

8. The patient treatment apparatus of claim 7, wherein;

said switch actuator includes a substantial surface area disposed between said table portion and said base portion adapted for movement in response to pressure thereon for actuating said safety switch.

9. The patient treatment apparatus of claim 8, wherein;

said switch actuator is mounted on said base portion with said substantial surface area facing said table portion and is resiliently biased upwardly toward said table portion away from actuating engagement with said safety switch.

10. The patient treatment apparatus of claim 9, wherein;

said safety switch is positioned below said switch actuator and is actuated by downward pressure on said switch actuator to said open position for deenergizing said motor.

11. The patient treatment apparatus of claim 6, wherein;

said control means includes circuit means for directing electrical power to said electric motor for moving said table between said first and second position, and said switch mat is interconnected in said circuit means for disconnecting electrical power to said electric motor for moving said table when downward pressure is present on said switch mat.

12. The patient treatment apparatus of claim 11, wherein;

said safety switch is interconnected in said circuit means for disconnecting electrical power to said electric motor in response to pressure on said actuator for discontinuing movement of said table toward said base.

13. Patient treatment apparatus, comprising:

a table having a surface for supporting a patient laying in a generally horizontal position for treatment at an elevated level above a floor surface said table having an end portion substantially perpendicular to said patient supporting surface;

a base adapted to rest on said floor surface, said base supporting said table for movement between a first substantially horizontal position for patient treatment and a second upstanding position for patient mounting and dismounting wherein said end portion of said table closely approaches said floor surface and allows said patient to mount upon and dismout from said table and end portion when said table is in said second upstanding position;

control means for moving said table between said first and second positions including electrically controlled hydraulic means; and safety means for deactivating said hydraulic means in response to a hazardous condition including switch mat means supported on said floor surface independently of said base and positioned on said floor surface adjacent said base directly below said approaching end portion of said table moving toward said second position.

14. The patient treatment apparatus of claim 13, wherein said switch mat includes a generally planar upper surface of substantial area adjacent said base responsive to downward pressure thereon to deactivate said hydraulic means.

15. The patient treatment apparatus of claim 14, wherein;

said table is supported for pivotal movement relative to said base between said first generally horizontal position and an upwardly extending second position wherein an end portion of said table downwardly approaches said switch mat means.

16. The patient treatment apparatus of claim 15, wherein;

said end portion of said table includes a footboard for supporting a patient in an upwardly extending position for mounting and dismounting from said apparatus as said table is pivoted toward said second position, said footboard being movable toward an outwardly extending position overlying said switch mat when said table is in said second position.

17. The patient treatment apparatus of claim 16, wherein; an underside of said footboard is positioned for movement toward engagement with said switch mat as said table is pivoted toward said second position, and wherein pressure exerted by said underside of said footboard and transmitted to said switch mat is effective to deactivate said hydraulic means.

18. The patient treatment table of claim 17, including;

safety means for deactivating said hydraulic means as said table approaches said horizontal first position wherein a portion of said table approaches an underlying portion of said base.

19. The patient treatment apparatus of claim 18, wherein;

said safety means includes a safety switch normally biased toward a switch closed position for activating said hydraulic means for moving said table relative to said base, and a safety switch actuator mounted on one of said base and said table operable to actuate said safety switch to an open position in response to pressure applied to said actuator for deactivating said hydraulic means to prevent further movement of said table portion toward said base portion.

20. The patient treatment apparatus of claim 19, wherein;

said switch actuator includes a substantial surface area disposed between said table portion and said base portion adapted for movement in response to pressure thereon for actuating said safety switch.

21. The patient treatment apparatus of claim 18, wherein;

said control means includes circuit means for directing electrical power to actuate said hydraulic means for moving said table between said first and second position, and said switch mat is interconnected in said circuit means for disconnecting electrical power to deactivate said hydraulic means from moving said table when downward pressure is present on said switch mat.

22. The patient treatment apparatus of claim 21, wherein;

said safety switch is interconnected in said circuit means for disconnecting electrical power for actuating said hydraulic means in response to pressure on said actuator for discontinuing movement of said table toward said base.

* * * * *